US007552954B2

(12) United States Patent
Rozo et al.

(10) Patent No.: US 7,552,954 B2
(45) Date of Patent: Jun. 30, 2009

(54) STORAGE BIN LATCH ASSEMBLY

(75) Inventors: Ximena Rozo, Seattle, WA (US); Patrick C. Moran, Seattle, WA (US); David A. Young, Bellingham, WA (US); Linsey K. Mallory, Montesano, WA (US); Juliane B. Trummer, Seattle, WA (US); Chris Samhammer, Redmond, WA (US); Richard K. Simms, Redmond, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 11/353,376

(22) Filed: Feb. 13, 2006

(65) Prior Publication Data

US 2007/0200366 A1 Aug. 30, 2007

(51) Int. Cl.
*E05B 3/00* (2006.01)
*E05C 1/06* (2006.01)

(52) U.S. Cl. ..... 292/336.3; 292/143; 292/173; 292/DIG. 31

(58) Field of Classification Search ..... 292/336.6, 292/DIG. 31, 143, 173, 92, 347, DIG. 65, 292/336.3; 70/208, 432, 438, 441, DIG. 59, 70/101, 141; 29/336.3
See application file for complete search history.

(56) References Cited

U.S. PATENT DOCUMENTS 986,659 A * 3/1911 Voight ..... 70/438
3,249,379 A * 5/1966 Ross ..... 292/166
3,266,275 A * 8/1966 Atkinson ..... 70/70
3,655,230 A * 4/1972 Armstrong ..... 292/169
3,790,197 A * 2/1974 Parker ..... 292/251.5
3,993,338 A * 11/1976 Cherbourg et al. ..... 292/336.3
3,993,339 A * 11/1976 Cherbourg et al. ..... 292/336.3
4,146,256 A * 3/1979 Snider et al. ..... 292/173
D303,620 S * 9/1989 Russell et al. ..... D8/313
6,240,752 B1 * 6/2001 Larsen et al. ..... 70/208
6,340,933 B1 1/2002 Chen et al.
6,357,806 B1 * 3/2002 Saku ..... 292/182
6,561,557 B2 * 5/2003 Choi ..... 292/336.3
7,168,755 B2 * 1/2007 Munezane ..... 296/152
D543,437 S * 5/2007 Mallory et al. ..... D8/330
D543,831 S * 6/2007 Druckman et al. ..... D8/330
2004/0074267 A1 4/2004 Linares

FOREIGN PATENT DOCUMENTS

DE 3532216 3/1987
EP 0289715 11/1988
FR 2857684 1/2005

OTHER PUBLICATIONS

Unknown, Touchy Subject, Aircraft Interiors International, Sep. 2005, UK & International Press, United Kingdom.

* cited by examiner

*Primary Examiner*—Carlos Lugo
(74) *Attorney, Agent, or Firm*—Ostrager Chong Flaherty & Broitman P.C.

(57) ABSTRACT

A latch handle assembly includes a bezel disposed within a panel and a handle having a center portion, a first grip portion, and a second grip portion. The center portion is disposed between the first grip portion and the second grip portion. The center portion pivotally mounts the handle within the bezel.

6 Claims, 4 Drawing Sheets

STORAGE BIN LATCH ASSEMBLY

TECHNICAL FIELD

The present invention relates generally to latches for moving panels and, more particularly, to latches particularly suited for overhead storage bins on an airplane.

BACKGROUND

Storage bins, and more particularly, overhead storage bins are used in airplanes to store carry-on luggage. Oftentimes the storage bins are used to capacity. Storage bins are placed in the open position so that passengers may place their carry-on luggage therein. Flight attendants or passengers close the storage bins when they are full.

A latch handle is typically used to actuate latches inside the storage bin and are used to release the storage bin so that it may be positioned in an open position. Oftentimes, one latch is provided for each of the sides of the storage bin.

During various maneuvers, storage bins may open allowing contents to potentially fall therefrom. Oftentimes this is due to one of the two latches not being fully latched. When the bins are closed one latch may not be latched but the other side may be latched. In a standing still position, the single latch may hold but during various maneuvers, the single latch may become unlatched.

It would therefore be desirable to provide a latch handle that may be easily visually inspected to provide an indication as to whether the latch is properly closed. Also, it is desirable to provide a latch handle that is easily actuated by people with various vertical attributes.

SUMMARY

In one aspect of the invention, a latch handle assembly includes a bezel disposed within a panel and a handle having a center portion, a first grip portion, and a second grip portion. The center portion is disposed between the first grip portion and the second grip portion. The center portion pivotally mounts the handle within the bezel.

In a further aspect of the invention, a latching assembly comprises a stationary member, a movable member disposed adjacent to and moving relative to the stationary member, a latch assembly having a latch disposed on the movable member, and a strike disposed on the stationary member. A bezel is disposed within the panel. A handle having a center portion, a first grip portion and a second grip portion is disposed within the bezel. The center portion is disposed between the first grip portion and the second grip portion. The center portion pivotally mounts the handle within the bezel. A transmission means couples the handle to the latch so that when the latch is in a latched position, the center portion is disposed substantially flush with the bezel, and when the latch is in an unlatched position, the first grip portion extends into the bezel and the second grip portion extends out of the bezel.

One advantage of the invention is that a visual indication of the unlatched latch is easily ascertainable. That is, when the latch is in an unlatched position, flight attendants may easily see that the latch is not properly latched. To enhance this, visual indicators may be provided on the edge of the latches so that an unlatched latch may be more evident.

Other advantages and features of the present invention will become apparent when viewed in light of the detailed description of the preferred embodiments when taken in conjunction with the attached drawings and appended claims.

DETAILED DESCRIPTION OF THE PREFERRED EMBODIMENT

Figure 1:
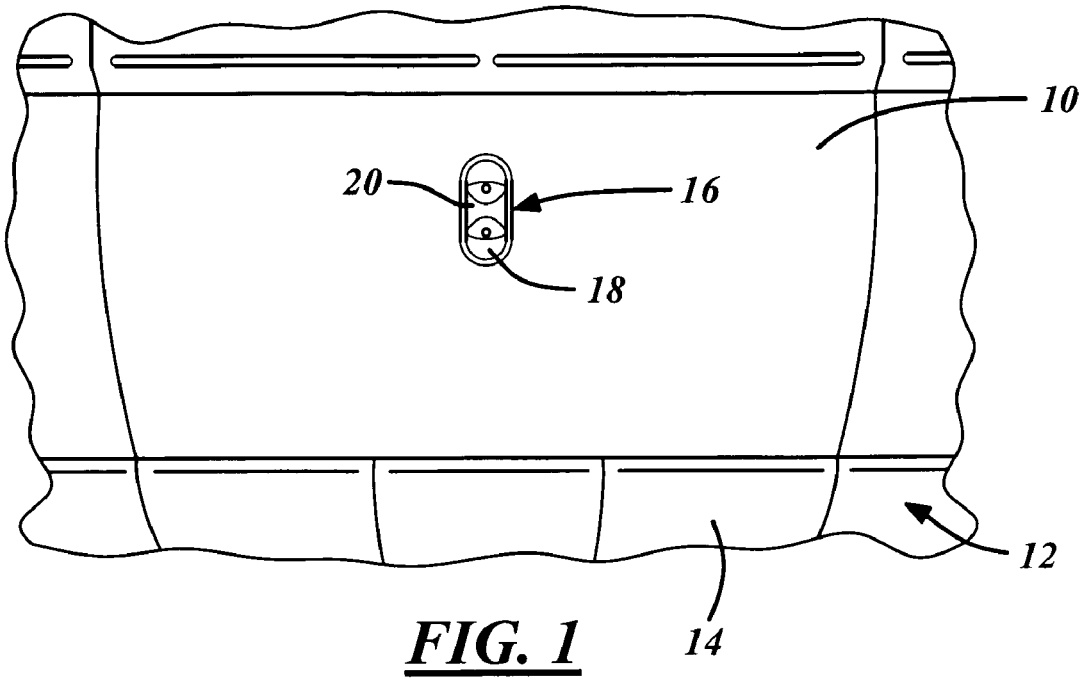
FIG. 1 is a perspective view of a movable panel illustrated as an overhead storage bin and door.

In the following figures the same reference numerals will be used to illustrate the same components. The present invention is described with respect to an overhead storage bin for an aircraft. However, the present invention is suitable for various locations within an aircraft. Also, the invention is suitable for use in various other types of applications beyond aircraft applications which include automotive and non-automotive uses.

Referring now to FIG. 1, a movable panel 10 for an overhead storage bin 12 for an airplane 14 (a portion of which is shown) is illustrated. The movable panel 10 includes a latch handle assembly 16 formed therein. The latch handle assembly 16 is used to actuate a latch to hold the overhead bin 12 in a closed position.

The latch handle assembly 16 includes a bezel 18 and a handle 20. The bezel 18 is generally flush with the surface of the panel 10 and is recessed therein. The handle 20 in a latched position is generally parallel to the outer edge of the bezel and the movable panel 10. As will be further described below, the handle 20 is generally flush with the bezel 18 so that it does not protrude except for grip portions as will be further described below.

Figure 2:
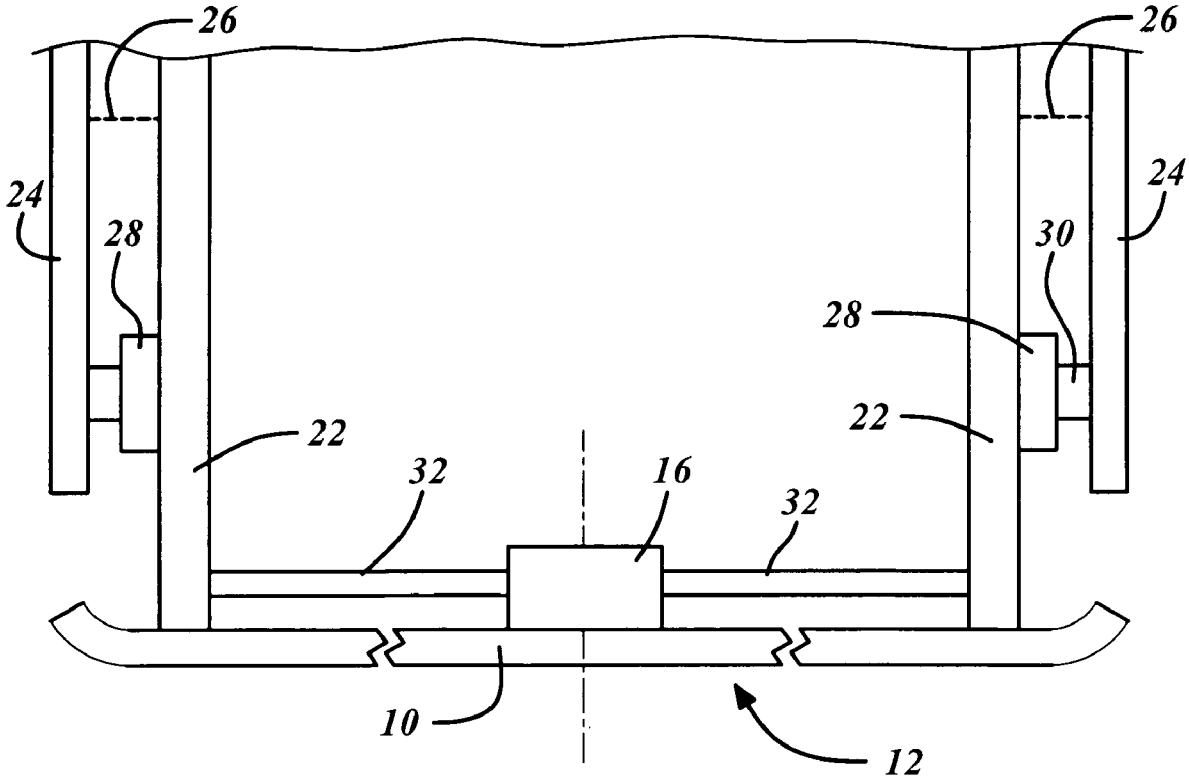
FIG. 2 is a schematic representation of a handle and latch assembly formed according to the present invention.

Referring now to FIG. 2, the overhead storage bin 12 is illustrated. The overhead storage bin 12 includes the movable panel 10 and end panels 22. End panels 22 move with the movable panels 10. In the art, the movable panel 10 may be called a face panel. The airplane 14 may include a stationary member 24. The stationary member 24 may be included on each of the overhead storage bin 12. The stationary member 24 may be coupled directly to the airplane or to another stationary structure of the airplane. A hinge 26 may be used to couple the stationary members 24 to the end panel 22. The end panel 22 may include a pair of latches 28. The stationary members 24 may include a strike 30. A transmission mechanism 32 is used to couple the latch handle assembly 16 to the latch 28. Transmission mechanism 32 allows the latch 28 to engage and disengage the strike 30 to hold the overhead bin in a closed position. As will be described below, it is desirable for both latches to be used to engage the strikes 30 so that the overhead bin is not inadvertently opened during the operation of the aircraft or other vehicle into which the latch assembly is mounted. As will be described below, an indication at the latch assembly may be provided to indicate that one of the latches is not properly latched. This is transmitted to the latch assembly through the transmission mechanism 32 in a mechanical fashion. The transmission mechanism 32 may be one of a variety of types of transmission mechanisms such as a torque tube, cables, arm linkages, cams, gears, or the like. The latch 28 may be various types of latches that are used to engage a strike 30. Various types of latches and strikes may be used.

Figure 3:
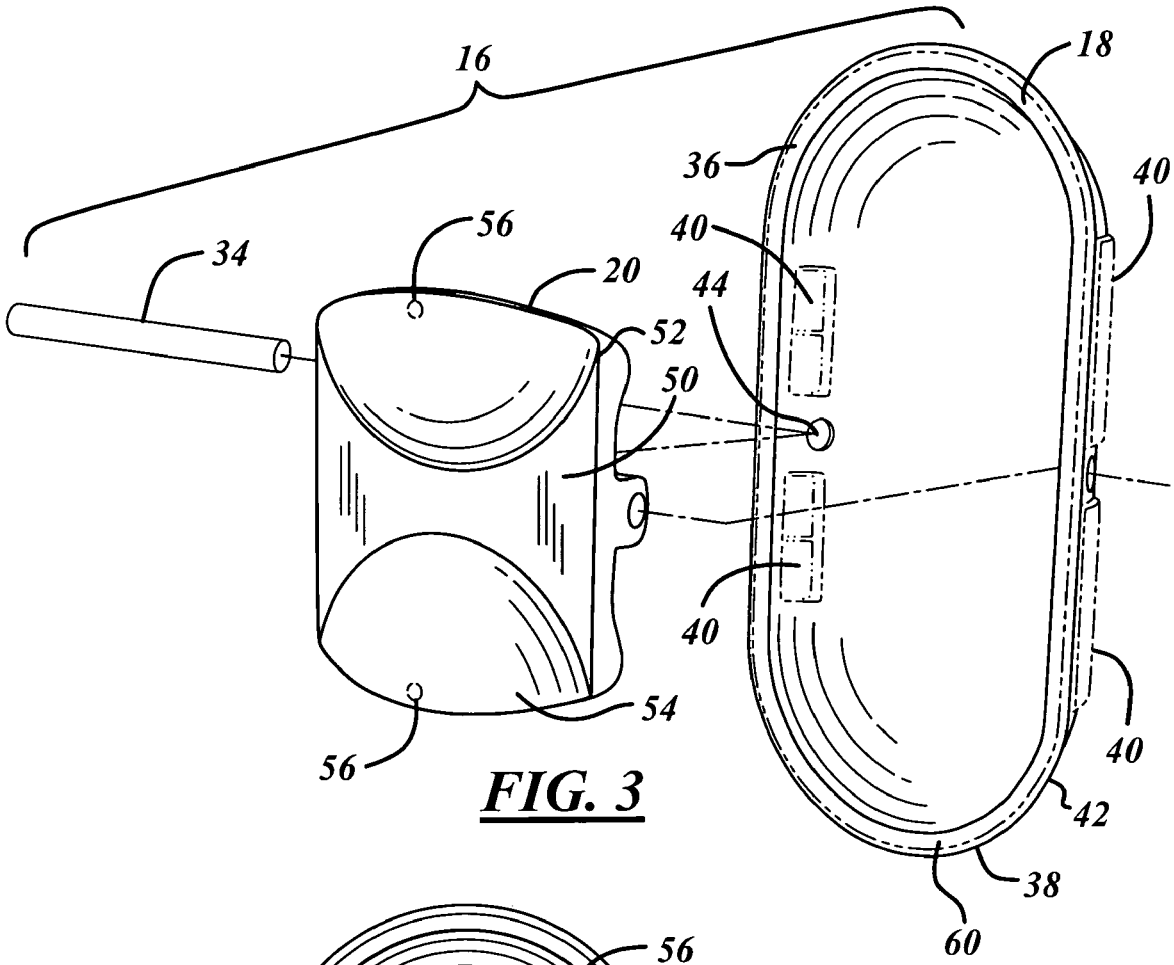
FIG. 3 is a perspective view of a first embodiment of a latch formed according to the present invention.

Referring now to FIG. 3, an exploded view of the present invention is illustrated. The latch handle assembly includes the bezel 18 and handle 20 that is received therein. A pin 34 couples the handle 20 to the bezel 18. The bezel 18 preferably has a first rounded end 36 and a second rounded end 38. The bezel may be made of various materials including plastic and metal. As mentioned above, the bezel is made to fit into a panel. A plurality of engagement ridges 40 may be integrally formed or mounted thereto. A flange 42 extends outward from the bezel 18. The panel is engaged between the flange 42 and the engagement ridges 40. Holes 44 within the bezel receive the pin 34.

The handle 20 includes a center portion 50 and a first grip portion 52 and a second grip portion 54. The center portion 50 is generally flush with the flange 42 of the bezel when the handle is inserted within the bezel 18. The first grip portion 52 and the second grip portion 54 may extend upward or outward from the bezel 18 so that it is easier to grip. A recessed portion 56 may be provided on each of the handle ends. The recessed portion 56 may be plain or may be colored to increase the aesthetic appeal of the device.

Figure 4:
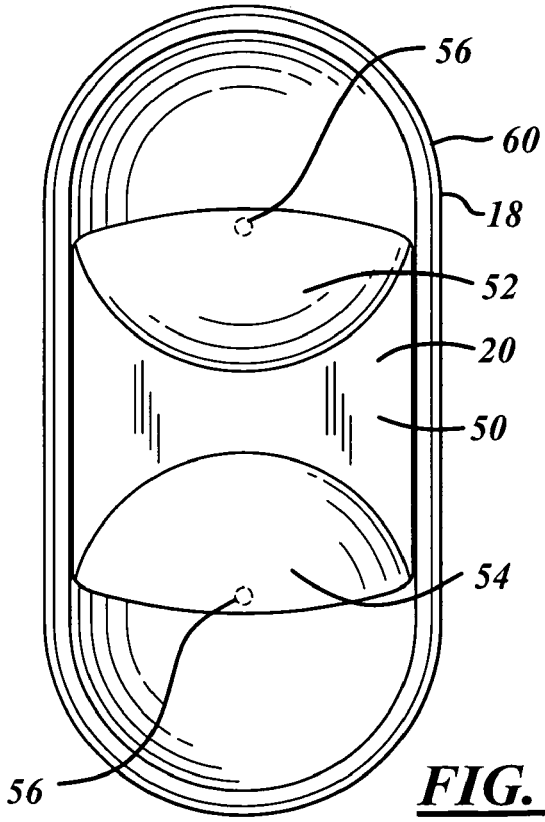
FIG. 4 is a front view of a latch formed according to the present invention.

Referring now to FIG. 4, the bezel 18 may include a decorative rim 60. For example, the decorative rim 60 may be formed of brightly colored material so that the latches may be easily located.

Figure 5:
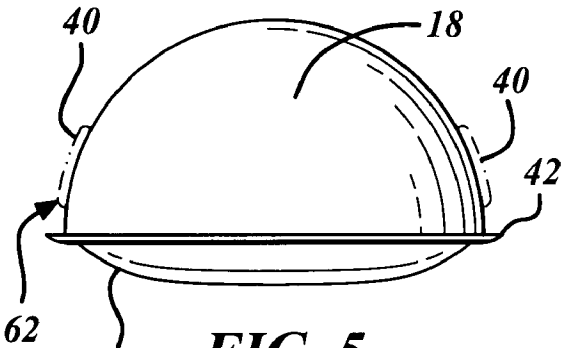
FIG. 5 is an end view of a latch of FIG. 4.

Referring now to FIG. 5, the second grip portion 54 is illustrated extending above the flange 42 of the bezel 18. Also, a space 62 used to receive the panel between the engagement ridges 40 and the flange 42 is illustrated.

Figure 6:
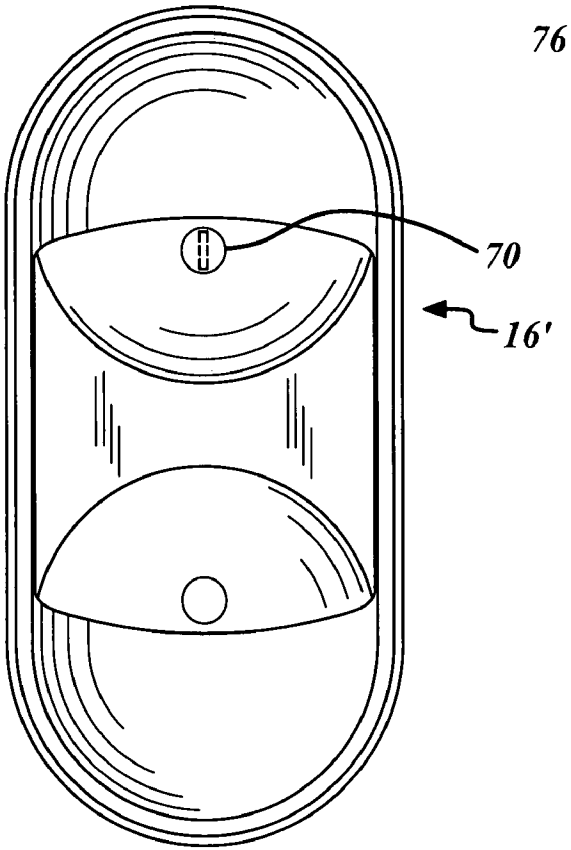
FIG. 6 is a front view of an alternative embodiment of a latch having a lock according to the present invention.

Referring now to FIG. 6, an alternative embodiment of the latch handle assembly 16' is illustrated. In this embodiment one recessed portion 56 is replaced by a lock 70. The lock 70 may be used to extend or retract a rod or other type of locking structure so that the bin may be the overhead bin or other assembly to which the latch assembly is coupled may be secured.

Figure 7:
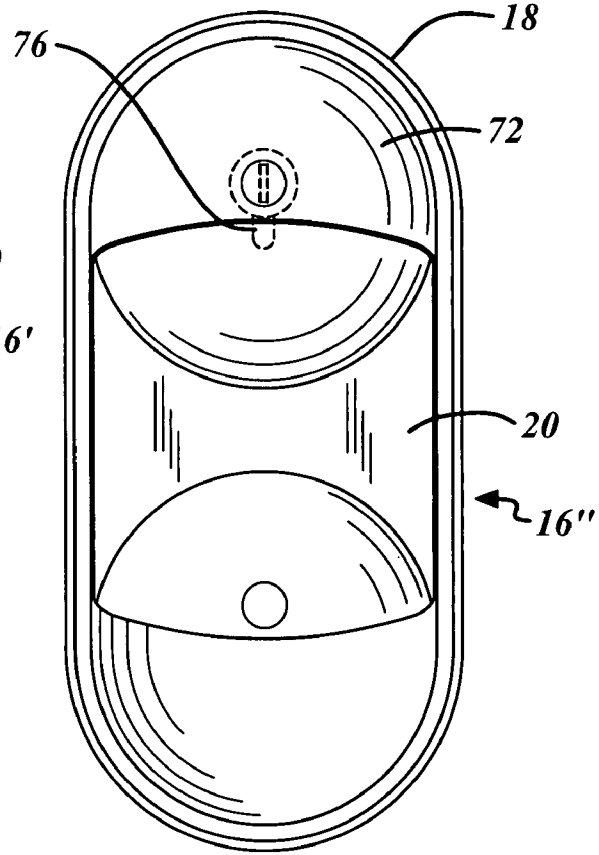
FIG. 7 is a front view of an alternative embodiment of a latch having a lock.

Referring now to FIG. 7, a third embodiment of latch handle assembly 16" is illustrated. In this embodiment, an insert 72 having a lock 74 thereon may be inserted between the handle 20 and the bezel 18. A lock mechanism 76 may be used to engage the handle 20 to prevent the handle from opening.

Figure 8:
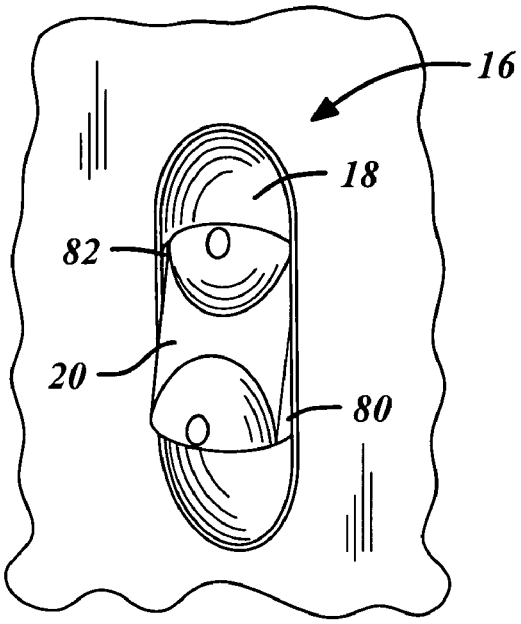
FIG. 8 is a perspective view of latch having an indicator according to the present invention.

Referring now to FIG. 8, latch handle assembly 16 may include a first indicator 80 on a side of handle 20 so that it is noticeable whether or not the latches are latched or unlatched. In FIG. 8, the latch handle assembly 16 is illustrated in an unlatched position. It should be noted that first indicator 80 may be positioned on both a first side and a second side of the latch so that the unlatched or latched position may be readily ascertained in either direction.

A second indicator 82 may be positioned on the bezel 18. The second indicator 82 may have a visible triangular shape when the latch is in an open position. Both the first indicator and second indicator may be formed from various types of paints, including a reflective paint, a red paint, a red reflective paint, or various types and colors of indicators. The handle 20 in a "popped out" position has the first grip portion 52 recessed within the bezel and second grip portion 54 extending outward from the bezel 18. When viewing the first indicator 80 or the second indicator 82, one of the latches 28 on either side of the bin does not engage the strike 30. See FIG. 2. Therefore, the handle remains in a position so that the indicator is visible and the handle is rotated outwardly on one end. This is an unlatched position.

Figure 9:
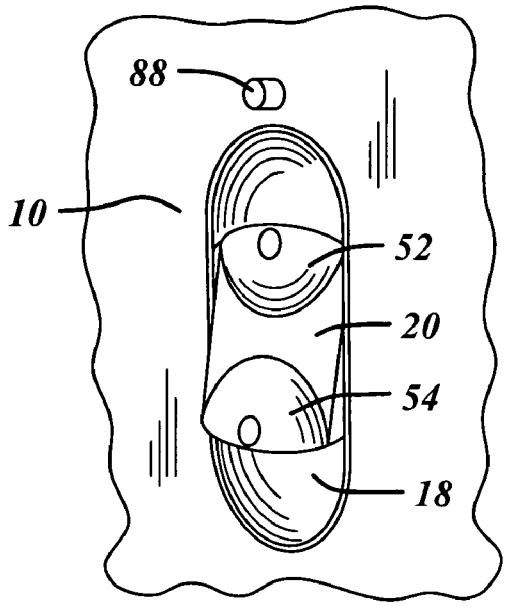
FIG. 9 is a perspective view of an alternative embodiment of a latch having a popup indicator.

Referring now to FIG. 9, the indicator takes the form of a pop out button 88. The pop out button 88 may be disposed above or below the latch on the panel 10. The pop out button 88 provides a second indicator to the handle 20 being disposed diagonally within the bezel 18. The pop out button 88 may be used alone as an indicator or together with the angled handle described in FIG. 8.

Figure 10:
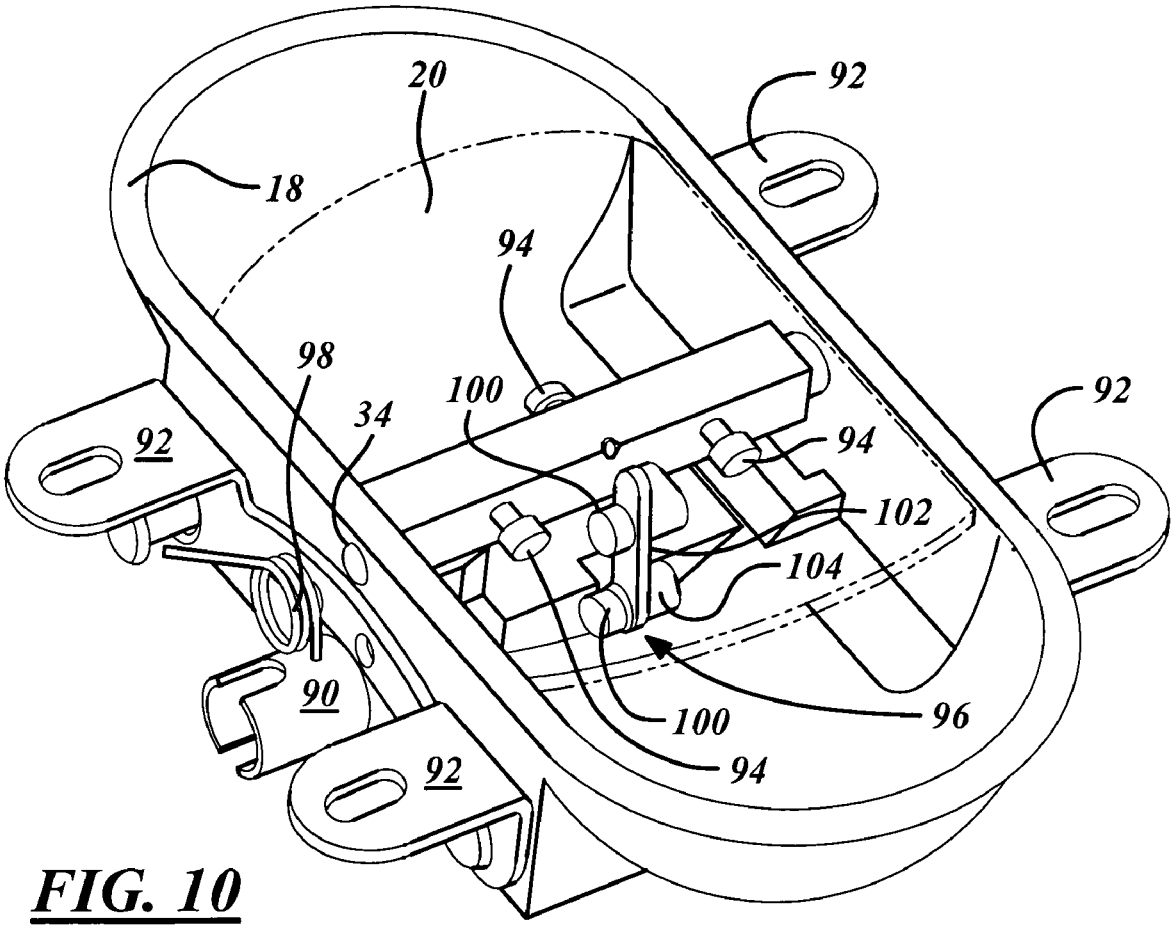
FIG. 10 is a perspective view of a latching mechanism according to one embodiment of the present invention.

Referring now to FIG. 10, another embodiment of the device is illustrated. In this embodiment, the bezel 18 has a handle 20 in a similar manner to those described above. However, the transmission mechanism 32 is formed of a torque tube 90. The torque tube 90 rotates in the same direction that the handle rotates. Brackets 92 are fixedly coupled to the bezel 18 rather than using the engagement ridges 40 in the previous embodiments. In this embodiment, couplers 94 are used to couple the handle 20 to the pin 34. An engagement mechanism 96 couples the handle 20 to the torque tube 90. As the handle 20 rotates, the torque tube 90 also rotates in the same direction. A spring 98 is coupled between the torque tube 90 and the bezel 18. The spring 98 may be various types of urging members. The spring 98 urges the handle 20 in an open position. Thus, unless the latches 28 shown in FIG. 2 are not engaged, the handle remains in the open or unlatched position.

The engagement mechanism 96 may include pivots 100 and a sliding arm 102. A paddle 104 engages the torque tube 90 and rotates the torque tube as the handle rotates.

While particular embodiments of the invention have been shown and described, numerous variations and alternate embodiments will occur to those skilled in the art. Accordingly, it is intended that the invention be limited only in terms of the appended claims.

What is claimed is:

1. A stowage bin latch assembly on an overhead storage bin for an airplane providing positive bin latch position status the overhead storage bin has a stationary member and a movable member disposed adjacent to and moving relative to the stationary member, the latch assembly comprising:

a latch disposed on the movable member movable between a latched and an unlatched position to engage a strike disposed on the stationary member;

a bezel disposed within a panel of the movable member;

a handle generally flush with the bezel and having a center portion, a first grip portion and a second grip portion, said center portion disposed between the first grip portion and the second grip portion, the center portion pivotally mounting the handle within the bezel by a pin, the first grip portion comprises a first visual indicator, the bezel comprises a second visual indicator and the latch assembly further comprises a third visual indicator positioned on the panel of the movable member adjacent the bezel and operatively connected to the handle;

a transmission mechanism coupling the handle to the latch so that when the handle is operated, it transmits an unlatch movement to the latch through the transmission mechanism, so that the latch can be moved to the unlatched position;

a spring member positioned between the bezel and the transmission mechanism;

when the latch is engaged with the strike in a latched position, the center portion and the first and second grip portions are disposed substantially flush with the bezel, the spring member is compressed, the first and second visual indicators are not visible and said third indicator is concealed within the panel of the movable member;

when the latch is in the unlatched position, the spring member maintains the handle in a position where the first grip portion extends out of the bezel and the second grip portion extends is moved into the inside of the bezel, making the first, second and third visual indicators visible to indicate that the latch is unlatched;

the visual indicators will be maintained exposed until the handle is moved against the biasing force of the spring member to be substantially flush with the bezel by movement of the latch by the strike toward the latch position;

wherein the first visual indicator is a painted surface on sides of the first grip portion, the second visual indicator is a painted surface of the bezel visible only when the second grip portion is moved into the bezel, and the third visual indicator is a pop out button that pops out through an aperture on the panel of the movable member when the latch is in the unlatched position.

2. A latch handle assembly as recited in claim 1 wherein the bezel comprises an elongated shape with rounded ends.

3. A latch handle assembly as recited in claim 2 wherein the bezel comprises a flange extending outwardly from said bezel and being disposed against an outer surface of the panel.

4. A latch handle assembly as recited in claim 3 wherein the flange comprises a decorative rim disposed there around.

5. A latch handle assembly as recited in claim 2 wherein in said latched position said center portion is disposed substantially flush with the flange of the bezel.

6. A stowage bin latch assembly for providing positive bin latch position status according to claim 1 wherein when the latch is in the unlatched position, the handle is rotated outwardly on one end.

* * * * *